United States Patent [19]

Niemann

[11] 4,057,366

[45] Nov. 8, 1977

[54] PORTABLE WATER EVACUATOR

[76] Inventor: Fred T. Niemann, 19 N. Mount Prospect, DesPlaines, Ill. 60016

[21] Appl. No.: 654,540

[22] Filed: Feb. 2, 1976

[51] Int. Cl.[2] ..... F04B 21/00; F04B 35/04

[52] U.S. Cl. ..... 417/234; 417/360; 417/424

[58] Field of Search ..... 417/360, 361, 359, 36, 417/37, 38, 39, 40, 41, 424, 234; 210/104, 163, 164, 165, 166, 416

[56] References Cited

U.S. PATENT DOCUMENTS

| | | | |
|---|---|---|---|
| 1,428,238 | 9/1922 | Keating | 417/424 |
| 1,462,708 | 7/1923 | Layne | 417/359 |
| 2,370,590 | 2/1945 | Taylor | 417/424 |
| 2,517,195 | 8/1950 | Gaspar | 210/163 |
| 3,046,900 | 7/1962 | Pollack | 417/424 |
| 3,168,868 | 2/1965 | Scholtz | 417/424 |
| 3,199,745 | 8/1965 | Hollis et al. | 417/234 |
| 3,748,066 | 7/1973 | Sully et al. | 417/424 |
| 3,751,187 | 8/1973 | Williams | 417/234 |
| 3,941,073 | 3/1976 | Ridgeway | 417/40 |

*Primary Examiner*—Carlton R. Croyle

*Assistant Examiner*—Thomas I. Ross

*Attorney, Agent, or Firm*—Dominik, Knechtel, Godula & Demeur

[57] ABSTRACT

A portable water evacuator generally comprising a cylindrical housing which is adapted to seat over and about the drain opening to contain any water within the housing which should back up through the drain. Within the cylindrical housing is disposed a submersible sump pump for discharging the water collected in the cylindrical housing to a distant point remote from the basement. With the portable water evacuator, when conditions are such that a heavy rain could cause flooding, the water evacuator can be placed over the drain, on a temporary basis. If the water does back up through the drain, the water will be collected in the cylindrical housing and discharged from the basement by the operation of the sump pump. The sump pump stands energized ready for operation, however, the pump is not actuated unless water actually is collected in the cylindrical housing. When weather conditions are such that no heavy rains are predicted, the portable water evacuator can be stored in an easily accessible location ready for use when needed.

6 Claims, 3 Drawing Figures

FIG. 1
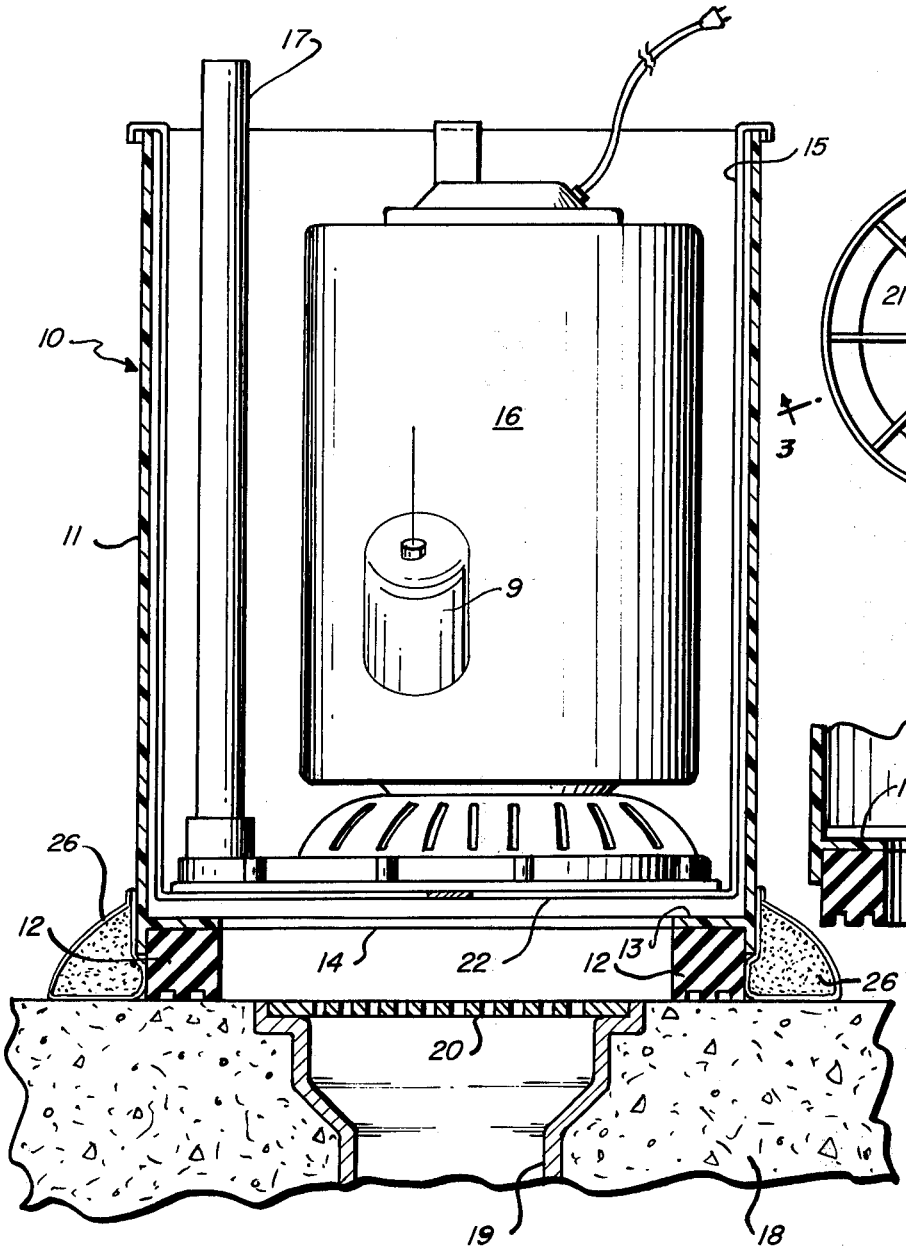
FIG. 2
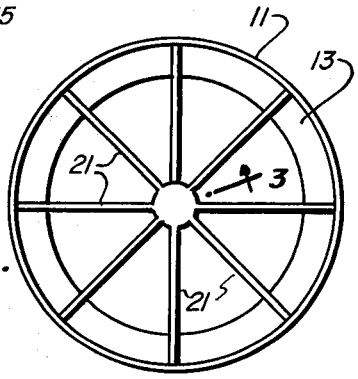
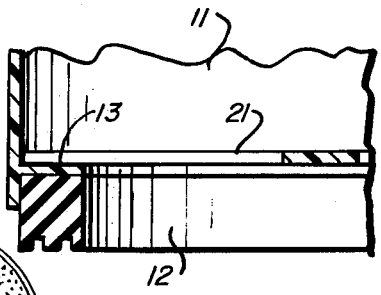
FIG. 3

PORTABLE WATER EVACUATOR

This invention relates to water evacuators and, in particular, to portable water evacuators for temporary emergency use.

It is generally common knowledge that many basements in homes and buildings are flooded to an extent that considerable damage results to appliances, furniture and other items commonly found in basements, particularly in homes, as a result of the storm sewers overflowing, so that water backs up through the drain pipes into the basements. Many homes have sump pumps in the basements which, under normal circumstances take care of any basement seepage. However, an equal or greater number of homes are without sump pumps but do have a drain in the basement floor. Various schemes have been proposed for combating the flooding of a basement as a result of the water backing up in the drain, such as, for example, the use of a stand pipe and check valves in the drain. However, none of these schemes have been entirely satisfactory, for one reason or another. For example, when a stand pipe is used, in many circumstances the water will back up in the laundry sinks and the like in the basement, if there is sufficient back pressure. Also, in the past it has not been uncommon that the basement floor has been caused to buckle as a result of the use of a stand pipe or a check valve in the drain opening.

The portable water evacuator of the present invention is particularly applicable for use in guarding against basement flooding, as a result of water backing up in the drain in the basement floor. Generally, the portable water evacuator comprises a cylindrical housing which is adapted to seat over and about the drain opening to contain any water within the housing which should back up through the drain. Within the cylindrical housing is disposed a submersible sump pump for discharging the water collected in the cylindrical housing to a distant point remote from the basement. With the portable water evacuator, when conditions are such that a heavy rain could cause flooding, the water evacuator can be placed over the drain, on a temporary basis. If the water does back up through the drain, the water will be collected in the cylindrical housing and discharged from the basement by the operation of the sump pump. The sump pump stands energized ready for operation, however, the pump is not actuated unless water actually is collected in the cylindrical housing. When weather conditions are such that no heavy rains are predicted, the portable water evacuator can be stored in an easily accessible location ready for use when needed.

Accordingly, it is an object of the present invention to provide an improved portable water evacuator.

More particularly, it is an object to provide an improved water evacuator which is particularly adapted for use in preventing basement flooding as a result of water backed up through the basement floor drain.

Other objects of the invention will in part be obvious and will in part appear hereinafter.

For a fuller understanding of the nature and objects of the invention, reference should be had to the following detailed description taken in connection with the accompanying drawings, in which:

FIG. 1 is a side, partially sectionalized view, of a portable water evacuator exemplary of the invention, the same being seated over and about a drain in the basement floor;

FIG. 2 is a top view of the bottom of a cylindrical housing for the water evacuator, the same being constructed in accordance with a second embodiment of the invention; and FIG. 3 is a partial sectional view taken along lines 3—3 of FIG. 2.

Similar reference characters refer to similar parts throughout the several views of the drawing.

Referring now to the drawing, in FIG. 1 the portable water evacuator 10 can be seen to include a cylindrical shaped shell or housing 11 which is opened at the top and has an inwardly extending flange 13 which extends about its interior periphery. The flange 13 is spaced a short distance from the terminal end of the side wall of the cylindrical housing 11 and functions to provide both an opening 14 in the bottom of the housing 11 and a shoulder or seat for a circular shaped sealing gasket 12. The cylindrical housing 11 can be of metal or other rigid material, however, preferably and advantageously it is molded of a rigid plastic so that it is both light weight and rust resistant. The sealing gasket 12 is of a compressible resilient type material such as rubber and is of a substantial thickness to support the portable water evacuator so as to provide a water tight seal about the drain 19 in the concrete floor or the like 18.

A hanger 15, having a base plate 22, which is perforated to permit water to flow through the base plate and at least two upright arms 23, is provided and seats interiorly of the housing 11. The upper ends of the arms 23 of the hanger 15 are formed to engage the upper edge of the side wall of the housing 11 to support the hanger 15 a spaced distance from the flange 13. This hanger 15 can be of a metal such as stainless steel or the like of sufficient rigidity to support a sump pump 16 within the housing 11.

The sump pump 16 can be any one of a number of commercially available submersible type sump pumps, such as, for example, the type manufactured by Red Jacket, Flint and Walling, Goulds and Jacuzzi Bros. Inc. Submersible sump pumps of this type have float switches, schematically represented by 9, to start and stop the pump as water rises and falls so that, in this case, if there is no water contained within the cylindrical housing 11, the pump is not actuated. Water pumped by the sump pump is discharged through a discharge pipe 17. The terminal end of the discharge pipe 17 can be threaded to receive the coupler on a garden hose or the like, for reasons described more fully below.

Since the entire unit is relatively light, the bulk of the unit comprising the weight of the sump pump 16, the water evacuator 10 normally can be stored out of the way in a convenient accessible location until its use is desired. If weather conditions are such that flooding conditions may result, the portable water evacuator 10 is placed over and about the opening of the drain 19 in the concrete floor 18, the drain in this case being illustrated with a perforated cover 20 on its open end. The sump pump 16 is energized by plugging it into any convenient electrical outlet. Since there is no water contained within the cylindrical housing 11, the sump pump 16 is not activated to pump water. A hose is coupled to the end of the discharge pipe 17 and can be led out of the basement through a basement window or the like so that any water can be discharged at a point remote from the building. The entire portable water evacuator 10 can be assembled and ready for operation within very few minutes time.

In the event flooding conditions should occur, and water backs up in the drain 19, the water is contained within the cylindrical housing 11 by the gasket 12 disposed beneath the housing 11. The water rises in the cylindrical housing to the point that the sump pump 16 is actuated by the operation of a float switch to discharge water through the discharge pipe 17. As indicated above, a hose or the like can be coupled to the end of the discharge pipe 17 so that the water can be discharged at a point remote from the building. Accordingly, any water which backs up in the drain pipe 19 will be collected and discharged, by the water evacuator 10.

When flooding conditions are no longer prevalent, the hose can be disconnected from the end of the discharge pipe 17 and the portable water evacuator 10 again stored in a convenient location for future use.

In FIG. 2, there is illustrated an alternative construction of the cylindrical housing 11. In this case, a number (in this case eight) of radially extending ribs 21 are provided on the lower end of the cylindrical housing 11 to support the sump pump 16. In this case, water which flows through the opening 14 formed by the flange 13 rises in the cylindrical housing 11 through the spaces between the ribs 21. These ribs 21 can be molded or otherwise integrally formed with the cylindrical housing 11 or, alternatively, the ribs 21 can be formed as a separate structure for seating within the cylindrical housing atop the flange 13.

In the event of a flood condition wherein the portable water evacuator 10 is utilized, the entire assembly can be easily cleaned since the sump pump 16 can be merely lifted out of the cylindrical housing 11. Once it is removed, it can be easily cleaned for storage. With the sump pump 16 removed, the interior of the cylindrical housing 11 likewise can be easily wiped clean for storage for subsequent use.

Accordingly, from the above description, it can be seen that a portable water evacuator is provided which can be easily stored and easily and quickly placed into use, by merely placing the same over the drain 19 in the floor, coupling the hose onto the end of the discharge pipe 17, and plugging the sump pump 16 into any convenient electrical outlet. Should any flooding conditions occur which result in water backing up in the drain 19, the water will be contained within the cylindrical housing 11 and discharged therefrom by the sump pump 16.

Alternatively or in addition to the sealing gasket 12, a weighted skirt 26 or the like can be affixed about the periphery of the housing 11 to function both as a seal and as a weight to secure the water evacuator in position. The weighted skirt 26 can be of a tubular construction, the same being of a fabric or plastic material or the like, and filled with sand or other such material which will cause the skirt to conform to the contour of the support surface to provide a substantially water tight seal.

It will thus be seen that the objects set forth above, among those made apparent from the preceding description, are efficiently attained and certain changes may be made in the above construction. Accordingly, it is intended that all matter contained in the above description or shown in the accompanying drawing shall be interpreted as illustrative and not in a limiting sense.

Now that the invention has been described, what is claimed as new and desired to be secured by Letters Patent is:

1. A portable water evacuator assembly comprising, in combination: a sump pump; a housing for removably supporting therein said sump pump, said housing being formed to removably seat over and about a floor drain and having a sealing gasket about its periphery at the lower end thereof for providing a substantially watertight seal between said housing and a support surface such that said sealing gasket seals off the area exterior to the area immediately above the floor drain and such that any water discharged from the floor drain is contained within and rises in said housing; said sump pump being actuated by means responsive to water rising within said housing to pump water out of said housing; and means for discharging water pumped by said sump pump to a remote location.

2. The portable water evacuator of claim 1, wherein said sealing gasket is of an elastermic material.

3. The portable water evacuator of claim 1, further including a hanger removably secured within said housing for supporting said sump pump above the floor drain.

4. The portable water evacuator of claim 1, further including a plurality of radially extending ribs within said housing for supporting said sump pump above the floor drain.

5. The portable water evacuator of claim 1, wherein said means for discharging water pumped by said sump pump to a remote location comprises a discharge pipe and a flexible hose adapted to be coupled to the end of said discharge pipe, whereby said hose can be extended to a location remote from said water evacuator to discharge water.

6. The portable water evacuator of claim 1, wherein said housing is cylindrical-shaped having an open top end, the bottom end having an opening therein through which water can pass.

* * * * *